US008047824B2

(12) United States Patent
Boskovic et al.

(10) Patent No.: US 8,047,824 B2
(45) Date of Patent: Nov. 1, 2011

(54) VANE MACHINE WITH STATIONARY AND ROTATING CYLINDER PARTS

(76) Inventors: Nebojsa Boskovic, Split (HR); Branimir Matijasevic, Zagreb (HR)

( * ) Notice: Subject to any disclaimer, the term of this patent is extended or adjusted under 35 U.S.C. 154(b) by 349 days.

(21) Appl. No.: 12/224,591

(22) PCT Filed: Mar. 6, 2006

(86) PCT No.: PCT/HR2006/000002
§ 371 (c)(1),
(2), (4) Date: Aug. 29, 2008

(87) PCT Pub. No.: WO2007/102033
PCT Pub. Date: Sep. 13, 2007

(65) Prior Publication Data

US 2009/0041604 A1 Feb. 12, 2009

(51) Int. Cl.
*F03C 4/00* (2006.01)
*F04C 15/00* (2006.01)
*F04C 2/00* (2006.01)

(52) U.S. Cl. ..... 418/133; 418/111; 418/146; 418/259; 418/268

(58) Field of Classification Search ..... 418/259, 418/266–268, 140, 141, 133–134, 146, 235, 418/111, 148
See application file for complete search history.

(56) References Cited

U.S. PATENT DOCUMENTS

| | | | | | |
|---|---|---|---|---|---|
| 2,071,799 | A | * | 2/1937 | Mabille | 418/138 |
| 3,437,079 | A | * | 4/1969 | Odawara | 418/111 |
| 4,616,985 | A | * | 10/1986 | Hattori et al. | 418/178 |
| 5,224,850 | A | * | 7/1993 | Pie | 418/148 |
| 5,634,783 | A | * | 6/1997 | Beal | 418/264 |

FOREIGN PATENT DOCUMENTS

| | | | | |
|---|---|---|---|---|
| GB | 388990 | | * | 9/1933 |
| JP | 05032095 | A | * | 2/1993 |
| JP | 08189487 | A | * | 7/1996 |

* cited by examiner

*Primary Examiner* — Theresa Trieu
(74) *Attorney, Agent, or Firm* — Graham & Dunn PC; Kathleen T. Petrich

(57) ABSTRACT

A vane-machine with cylinder stationary and rotating parts is intended for use as a driving or a working machine, utilizing compressible or non-compressible media as the working fluid. The vane-machine basic embodiment comprises: a cylinder stationary part (A), cylinder rotating parts (B), a rotor (C), covers (D), and vanes with grooves (F). The cylinder stationary part has a shroud (1) within which the rotor with the vanes rotates. In the shroud there are radial rectangular openings (5 and 6) letting the media in and out. The openings may be of other shapes as well. The inner ring (8) of roller or sliding bearings are rotationally driven by the vanes. The rotor is positioned eccentrically-relative to the shroud axes. At the rotor there are firmly fitted lateral plates (14) that rotate jointly with the rotor. The vane-machine working chamber is delimited with the shroud, the inner rings, the vanes and the plates.

10 Claims, 6 Drawing Sheets

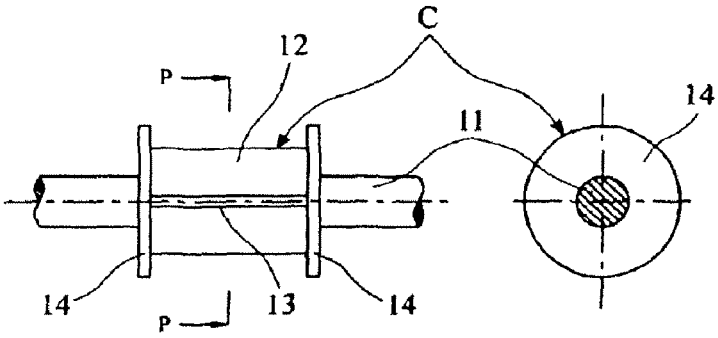
Fig. 19 Fig. 20
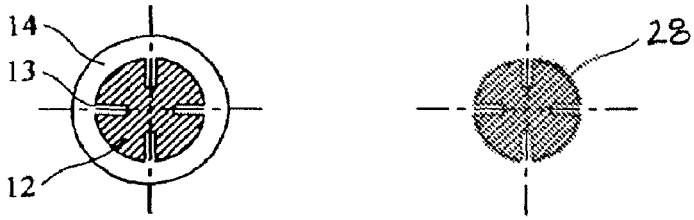
Fig. 21 Fig. 22
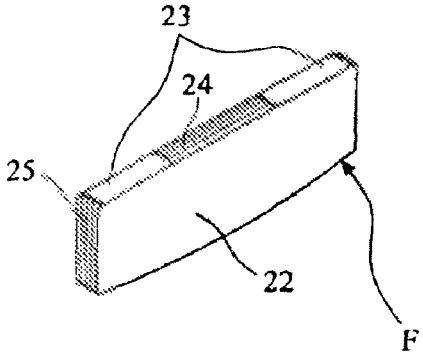
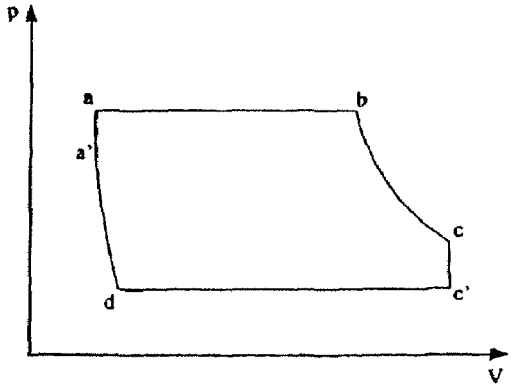
Fig. 23 Fig. 24

VANE MACHINE WITH STATIONARY AND ROTATING CYLINDER PARTS

1. FIELD OF APPLICATION

The invention relates to vane machine where part of the cylinder is stationary while other cylinder parts rotate.

The vane machine may be a working machine (engine) for continuous converting of fluid energy into mechanical power or a driving machine (pump) for continuous raising, forcing, compressing, or exhausting of fluid by mechanical power or other means, from the volumetric rotating machine group, utilizing compressible or incompressible fluids as the working media.

In the International Patent Classification, it is classified as the Field F—Mechanical engineering; Class F 01—Machines or engines in general; Subclass F 01 C—Rotary piston machines or engines; Group 13/00—Adaptations of machines or engines for special use, combinations of engines and devices driven thereby; Subgroup 13/02—for driving hand-held tools or the like; and 13/04—for driving pumps or compressors.

2. TECHNICAL PROBLEM

The greatest problem present with volume machines, especially with vane volumetric machines, are the volumetric and the mechanic losses. Volume losses result from the insufficiently large openings letting the working media in and out of the working chamber of the machine. Volumetric losses also appear due to leakage of the fluid from higher-pressure space of the working chambers into lower-pressure space of the working chambers. Mechanic losses result from friction between the machine's mutually contacting rotating and stationary parts that make parts of the working chamber.

Consequence of the higher volumetric and mechanical losses is the lower volumetric and mechanical effectiveness of the machine, that is, its low total effectiveness.

The technical problem solved by the invention is an enhanced charging and discharging of the working chamber with the working media, also decrease of wear of the vane surfaces in contact with the cylinder axial and radial surfaces, and enhanced sealing of vanes against the cylinder axial and radial surfaces.

3. STATE OF THE ART

In vane machines, the vanes are pressed against the cylinder walls in the working chamber by the centrifugal force, in some embodiments additionally by springs or providing the vane inner radial surface with the working-media pressure.

Wear of the stationary-cylinder vane machines is proportionate to the total force pushing the vane against the cylinder surface in the working chamber and to the friction coefficient. The friction problem is being solved, among others, by selection of materials of which the vanes and the cylinder are made. The vanes may be axially moved, wherefore they lean against the working chamber stationary lateral surfaces. Due to the relative high velocities between the vane lateral surface and the working-chamber lateral surfaces, ware is present in both surfaces in contact, that is, the mechanical efficiency of the machine is deteriorated. In this embodiment, the working chamber may be charged and discharged radially, which is favorable with regard to the volumetric efficiency.

In another vane-machine embodiment, the cylinder rotates, wherefore the relative velocities at the contact between the cylinder surface, which rotates in the chamber, and the vane is decreased, this again resulting in decrease of wear, which is favorable with regard to the mechanic efficiency. The setback of this embodiment are the working-media axial intake and exhaust, unfavorably effecting charging and discharging of the chamber, thus worsening the volumetric efficiency.

Similar to the first embodiment, the vanes may be axially moved, wherefore they lean against the chamber stationary lateral surfaces. Due to the relatively large velocities between the vane lateral surface and the working-chamber lateral surfaces, wear is present in both surfaces in contact.

The state of the art is defined by two patent documents, that solve the known technical problems only partially.

JP 08 18987 A—offers solution of the problem of wearing of cylinder parts.

U.S. Pat. No. 3,437,079 A—solves mechanical losses at cylinder and working chamber lateral surfaces and the losses from leakage on cylinder. It has vanes with axial grooves on upper side of the vane body.

4. DISCLOSURE OF THE INVENTION

The essence of the invention is machine that has stationary and rotating cylinder parts.

In the stationary cylinder part there are radial openings allowing the working media to pass through in and out of the cylinder working chamber.

The cylinder rotating parts are roller or sliding bearings, firmly inserted in the cylinder stationary part. Bearing inner rings, or additional rings, firmly inserted in the bearing inner rings, are actuated by the vanes to rotate.

Lateral plates, closing the cylinder working chamber are firmly pulled over the rotor and rotate with it.

The vanes with axial and radial grooves are inserted in rotor, enhancing sealing of working media between the vanes and other parts in contact. Sealing is of the labyrinth type.

5. ILLUSTRATION DESCRIPTIONS

FIG. 19 shows rotor C—front view.

FIG. 20 shows rotor C—side view.

FIG. 21 shows rotor C—cross-section P-P in the FIG. 20.

FIG. 22 shows rotor body with grooves—transversal cross-section.

FIG. 23 shows vane with grooves E—perspective view (enlarged).

FIG. 24 shows p-v diagram of operating cycle of the driving vane machine with compressible working media.

Figure 1:
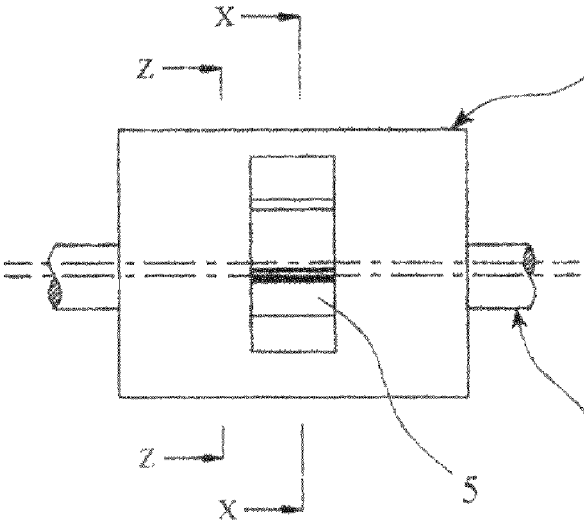
FIG. 1 shows closed vane machine—front view.
Figure 2:
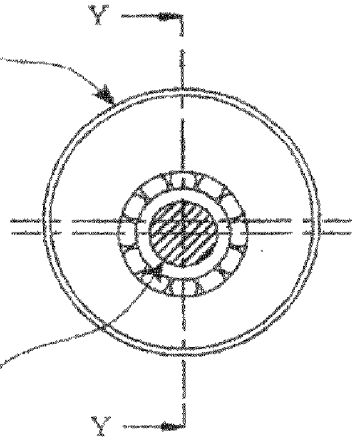
FIG. 2 shows closed vane machine—side view.
Figure 3:
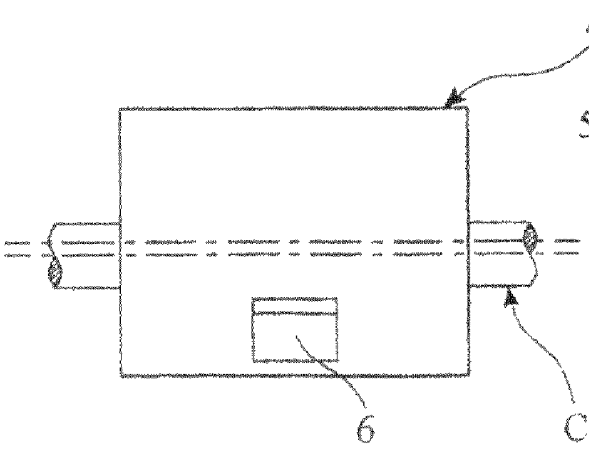
FIG. 3 shows closed vane machine—back view.
Figure 4:
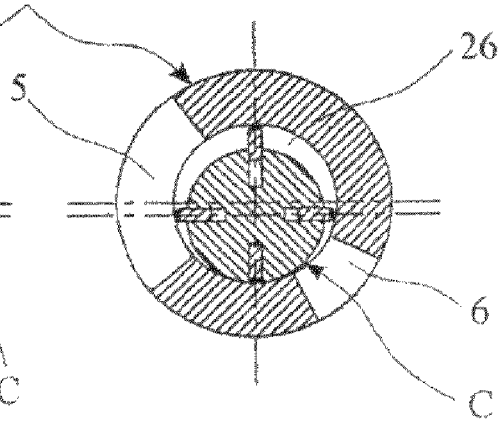
FIG. 4 shows vane machine—cross-section X-X in the FIG. 1.
Figure 5:
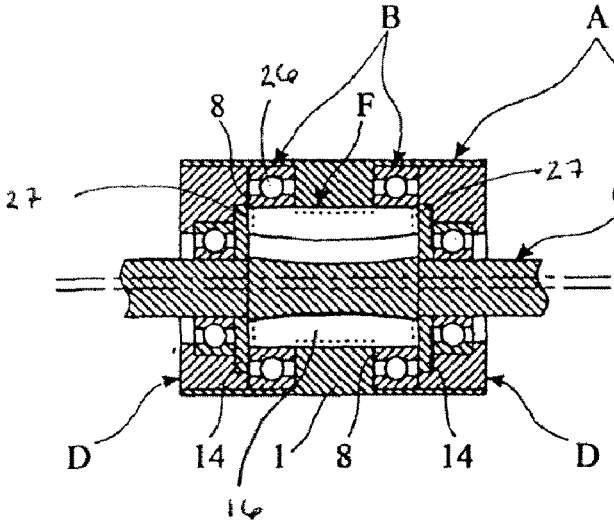
FIG. 5 shows vane machine with no additional ring—cross-section Y-Y in the FIG. 2.
Figure 6:
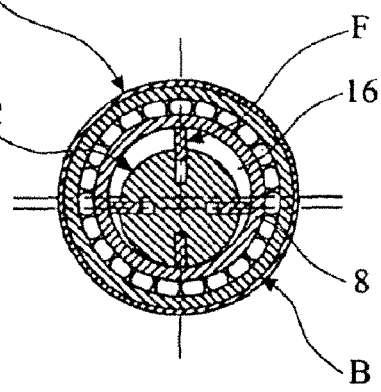
FIG. 6 shows vane machine with no additional ring—cross-section Z-Z in the FIG. 1.

6. DETAILED DESCRIPTION OF ONE OF THE INVENTION BEST EMBODIMENTS AND ITS FUNCTIONING

The invention description relates to the vane-machine basic version, the cylinder of which consists of one stationary and two rotating parts.

More complex versions of the vane machine may consist of several stationary and rotating cylinder parts, where all combinations of layouts and sizes, depending on the required technical characteristics, are possible.

The basic vane-machine embodiment, as shown in the FIGS. 1 to 23, comprises: cylinder stationary part A, cylinder rotating parts B, rotor C, covers D, and vanes F.

Cylinder Stationary Part A

The cylinder stationary part A is shown in the FIGS. 11, 12, 13 and 14, viewed from front, side, back and in the cross-section R-R.

The cylinder stationary part A is shaped as a hollow roller, in the centre of its hollow part having the inner shroud 1 with the working surface 2 and the lateral surfaces 3. Within the shroud rotates the rotor C.

At the intake and the exhaust, the cylinder stationary part has the openings 4, for the covers D.

In the shroud 1 there is the opening 5, allows the working media to pass through in, and the opening 6, allows the working media to pass through out of the cylinder working chamber. Openings 5 and 6 are rectangular and radial relative to the cylinder. Openings 5 and 6 may be of other shapes as well.

Cylinder Rotating Parts B

The cylinder rotating parts B may be designed in one of the following two variants:

variant 1—without additional rings;

variant 2—with additional rings.

Figure 7:
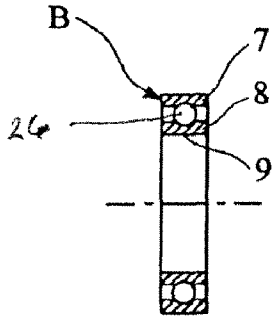
FIG. 7 shows rotating part of the cylinder B with no additional ring—longitudinal cross-section.
Figure 10:
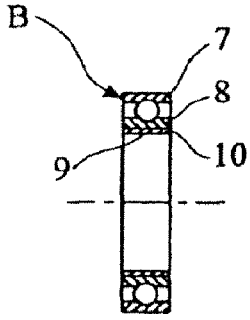
FIG. 10 shows rotating part of the cylinder B with additional ring—longitudinal cross-section.
Figure 8:
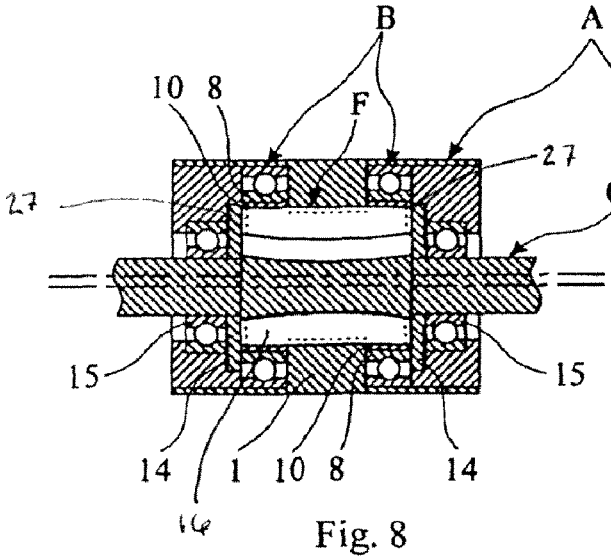
FIG. 8 shows vane machine with additional ring—longitudinal cross-section.
Figure 9:
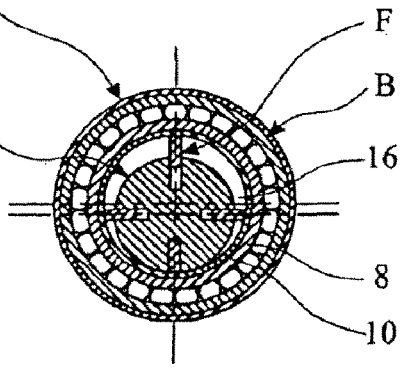
FIG. 9 shows vane machine with additional ring—transversal cross-section.
Figure 11:
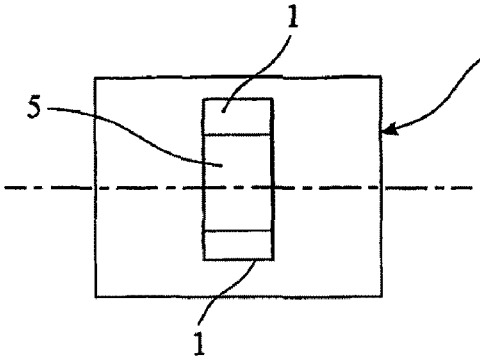
FIG. 11 shows stationary part of the cylinder A—front view.
Figure 12:
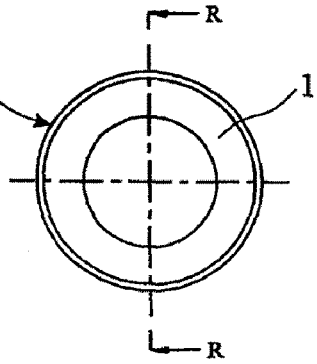
FIG. 12 shows stationary part of the cylinder A—side view.
Figure 13:
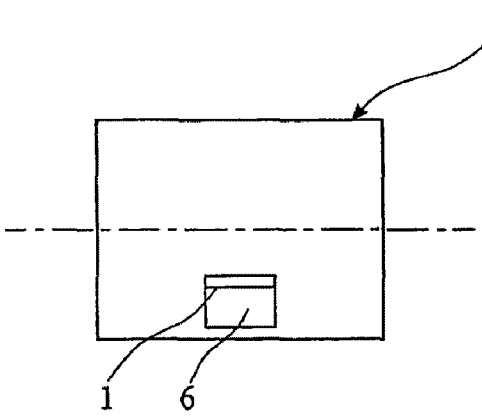
FIG. 13 shows stationary part of the cylinder A—back view.
Figure 14:
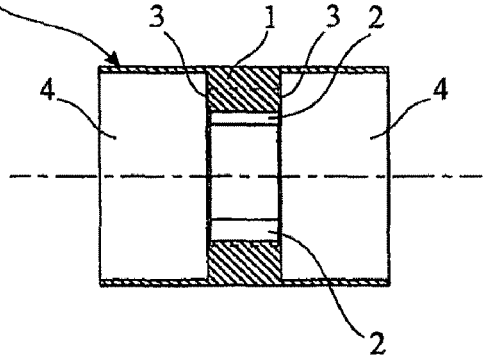
FIG. 14 shows stationary part of the cylinder A—longitudinal cross-section R-R in the FIG. 13.
Figure 16:
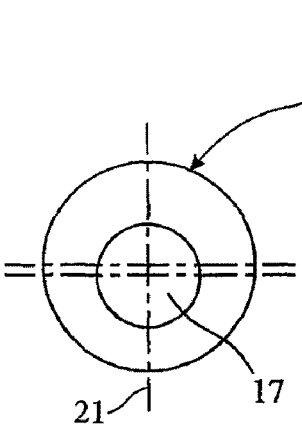
FIG. 16 shows cylinder cover D—left side view.
Figure 15:
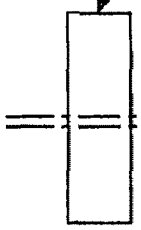
FIG. 15 shows cylinder cover D—front view.
Figure 17:
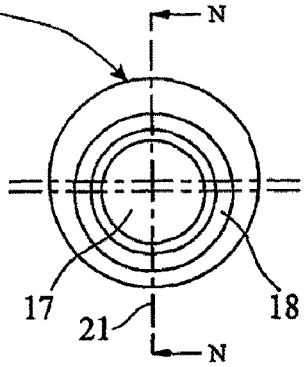
FIG. 17 shows cylinder cover D—right side view.
Figure 18:
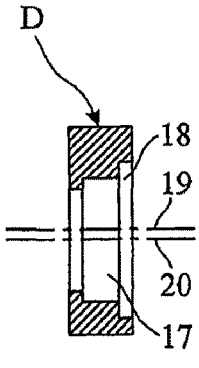
FIG. 18 shows cylinder cover D—cross-section N-N in the FIG. 17.

FIG. 7 shows the variant 1 of the cylinder rotating parts, with no additional rings, which rotating parts are in fact bearings having the outer ring 7 and the inner ring 8 with the working surface 9. As shown in the FIGS. 5 and 6, the bearings are firmly inserted in openings 4 of the cylinder stationary part A, leaning against the lateral surface 3 of the shroud 1. The inner rings 8 rotate, actuated by the vanes F. FIG. 10 shows the variant 2 of the cylinder rotating parts, with the additional ring, which rotating parts are in fact bearings having the outer ring 7 and the inner ring 8, in which there is firmly inserted the additional ring 10 with the working surface 9. As shown in the FIGS. 8 and 9, the bearings are firmly inserted in openings 4 of the cylinder stationary part A, leaning against the lateral surface 3 of the shroud 1. The inner rings 10 rotate, actuated by the vanes F.

The cylinder rotating parts B, in the variants 1 and 2, may be roller or sliding bearings 26.

Rotor C

As shown in the FIGS. 19, 20, and 21, the rotor C has the shaft 11, the body 12 with the longitudinal slots 13 and the lateral plates 14. The plates 13 are pulled firmly over the shaft and leaning against the rotor body to close the cylinder working chamber 16 from its lateral sides that form cylinder ends 27 of the working chamber. In the rotor body there are, under the 90° angle, cut four longitudinal slots 13 receiving the vanes F, so that the angle between the vane surface and the rotor radial direction is zero. The rotor rotates in the cylinder working chamber 16, jointly with the plates and the vanes. The rotor rotates in the bearings 15, which may be roller or sliding bearings. The bearings are firmly inserted in the openings 17 of the cover D.

The rotor may have one or several vanes.

Slots in the rotor body may also be designed to enable the vanes to move under an angle formed by the vane surface and the rotor radial direction.

As shown in the FIG. 22, in the outer surface of the rotor body that may be cut longitudinal grooves 28 that create labyrinth sealing.

Covers D

As shown in the FIGS. 15, 16, 17 and 18, the covers D have openings 17 to receive the bearings 15 in which the rotor rotates. The covers are firmly inserted in the openings 4 of the cylinder stationary part, FIG. 14, so that they lean against the outer ring 7 of the cylinder rotating part B, FIGS. 5 and 8. Openings 17 are made eccentric related to the cover axial axis 19.

Vanes F

The vanes may be made with or without grooves. This invention description relates to a vane machine having vanes with grooves in its rotor (labyrinth sealing).

The vanes F, FIG. 23, have the body 22 in which, in the central part of the upper surface and between two flat parts 23, there are cut axial grooves 24, whereas by the whole length of both lateral narrower surfaces there are cut radial grooves 25. The vanes are inserted in the slots 13 in the rotor body. Lengths of the vane flat parts 23 correspond to the width of the inner ring 8 or the additional ring 10 respectively, of the cylinder rotating part. Length of the axial grooves 24 correspond to the width of the shroud 1 of the cylinder stationary part.

As the rotor rotates, the vane flat parts 23 actuate the inner rings 8 or the inner rings 10 respectively, of the cylinder rotating part.

Functioning of the Invention

Views of a closed and assembled vane machine are shown in the FIGS. 1—front, 2—side, 3—back, and 4—cross-section X-X.

The vane-machine working chamber 16, FIGS. 5, 6, 8 and 9, is defined by the shroud 1 of the cylinder stationary part A, the inner rings 8 or the additional rings 10 of the cylinder rotating parts B, the plates 14 and the body 12 of the rotor C, and the vane flat part 23 and the axial grooves 24 of the vanes F. With regard to the number of the vanes, the working chamber may be divided into two or more parts.

The vane machine works by the principle of creating the tangential force, resulting from the pressure difference at the rotor vanes. The tangential force at the rotor shaft appears as the torque momentum that, besides the working number of revolutions of the machine, generates the engine power. As with driving machines (engines), the machine power transforms into the mechanic work available, whereas as working machines (pump) the available power is used to change the working fluid pressure with a given flow.

The vane machine with cylinder stationary and rotating parts is powered by bringing the media through the opening 5 into the cylinder working chamber 16. In this process the working media, due to the pressure difference, makes the rotor to rotate. Media in the space between two vanes leaves the cylinder working chamber 6 through the media exhaust opening at the opposite side of the cylinder, and the cycle repeats.

Rotation of the rotor creates a centrifugal force that pushes the vanes F out of the slots 13, this creating friction between the vane flat parts 23 and the working surface 9 of the bearing inner rings 8 or the additional ring 10, and them (putting inner rings 8 or the additional rings 10) in motion.

The velocities of sliding of contact surfaces of the vanes and the bearing inner rings or the additional rings firmly inserted in them, makes the difference between the momentary peripheral velocities of the vane outer edge and the momentary peripheral speed due to the inner ring rotation. In this machine, the said velocities depends on the number of vanes. For only one vane in the rotor the relative velocities is zero, whereas for several vanes the maximum sliding velocities equals the mean speed resulting from the difference of the vane velocities of the maximum and minimum peripheral velocities relative to the current bearing inner-ring rotation velocities. The role of the cylinder rotating part with the bearing rings is to decrease the sliding velocities, thereby to decrease the friction, noise and wear rate, which all increase the vane-machine's mechanical efficiency.

The vanes are axially movable, leaning against the plates 14 of the rotor C. The plates are firmly connected to the rotor and, therefore, rotate with it. This way it is achieved the minimum relative velocities of sliding between the vane lateral edges and the plates, this again resulting in decrease of the rate of friction wear and increase of mechanical efficiency. The relative velocities between the vane lateral edges and the working-chamber plates results from the vane radial motion. Between the vanes and the cylinder stationary part, or the working surface 2 of the shroud 1, there is a clearance wherefore there is no mutual contact, which avoids friction wear at this region.

Such vane-machine embodiment enables the working media intake opening 5 and the exhaust opening 6 to be positioned radially, whereby, and due to their size, shape and position, better charging and discharging of the working chamber is achieved (volume efficiency), which is among major setbacks of the presently known vane-machine embodiments.

The relative speed between the rotating inner rings, or the bearing additional rings, and the vanes is significantly decreased, wherefore the vane friction wear is decreased.

Pressure of the vanes against the rotating inner rings, or the bearing additional rings, creates sealing at this region. The pressure may, if necessary, be additionally increased by a spring placed in the vane slot or by providing the vane inner radial surface with the working media of higher pressure, which results in an additional radial force.

Rotation of the rotor creates conditions for periodical charging and discharging of the working chamber, wherefore, depending on the vane-machine purpose, the working-chamber pressure, from intake to exhaust, is increased or decreased.

The vane machine with cylinder stationary and rotating parts decreases ware of the vane contact surfaces in contact with the cylinder axial and radial walls in the vane-machine working chamber, enhances charging and discharging of the working chamber with the working media, and solves the issue of sealing between the vanes and the cylinder inner stationary part and the rotor lateral plates. This enhances the volumetric efficiency of the machine and decreases losses resulting from friction between the contact surfaces, wherefore the mechanical efficiency of the machine is increased.

Figure 25:
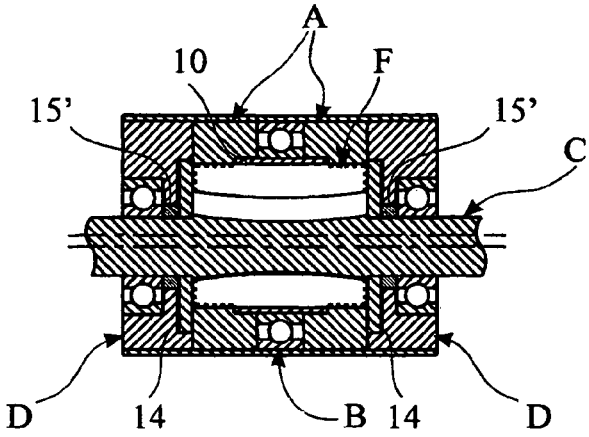
FIG. 25 shows vane machine with one rotating part between two stationary parts of the cylinder, with a wider additional ring, with lateral plates in eccentric openings in covers and rings between lateral plates and bearings—longitudinal cross-section.
Figure 26:
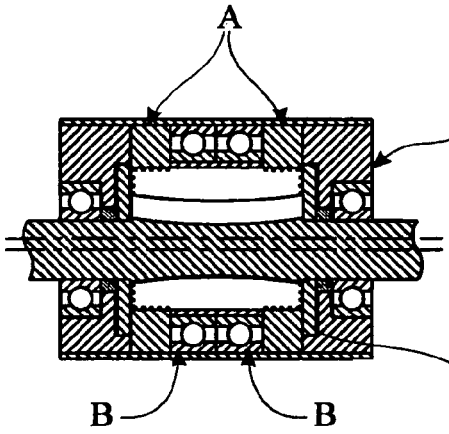
FIG. 26 shows vane machine with two rotating parts and one additional ring for both rotating parts, between two stationary parts of the cylinder, with lateral plates in eccentric openings in covers and rings between lateral plates and bearings—longitudinal cross-section.
Figure 27:
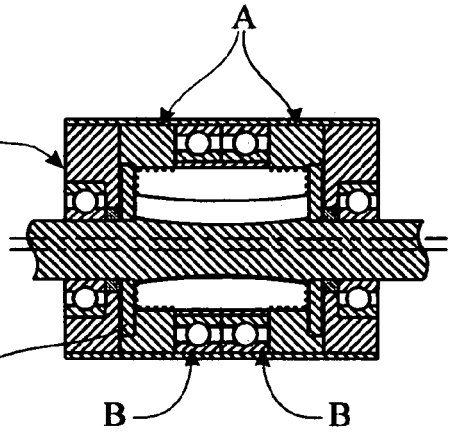
FIG. 27 shows vane machine with two rotating parts between two stationary parts of the cylinder, with one additional ring for both rotating parts, with lateral plates in stationary parts of the cylinder, with eccentric openings in covers and rings between lateral plates and bearings—longitudinal cross-section.
Figure 28:
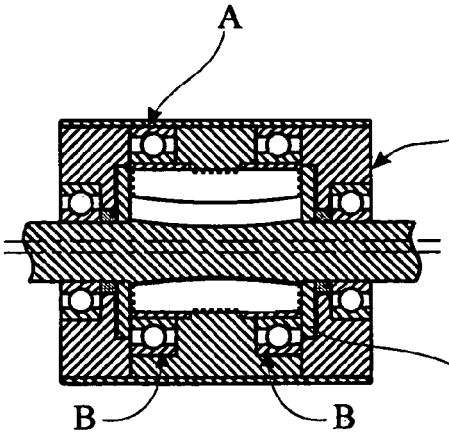
FIG. 28 shows vane machine with one eccentric stationary part between two rotating parts of the cylinder, with wider additional rings, with lateral plates in central openings in covers and rings between lateral plates and bearings—longitudinal cross-section.
Figure 29:
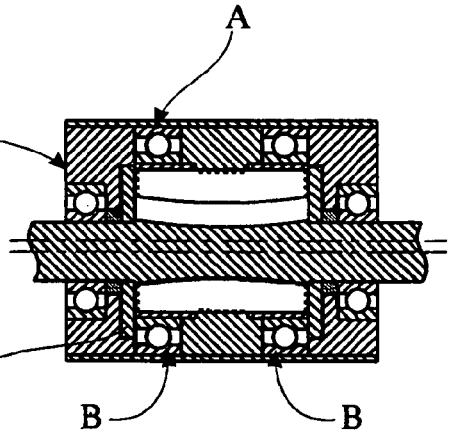
FIG. 29 shows vane machine with one stationary part between two rotating parts of the cylinder, with wider additional rings for both rotating parts, with lateral plates in eccentric openings in covers and bearings between lateral plates and bearings—longitudinal cross-section.
Figure 30:
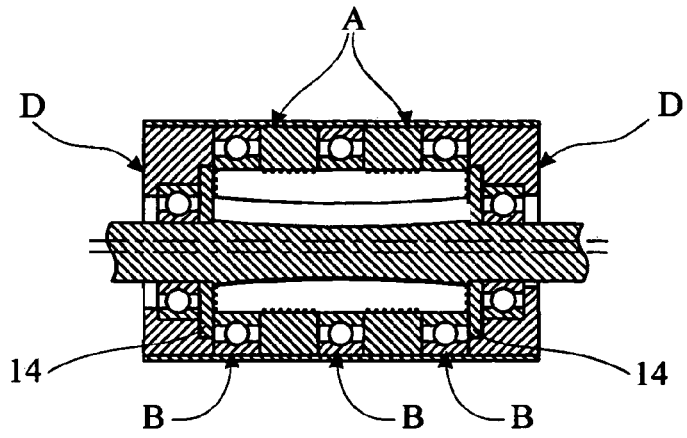
FIG. 30 shows vane machine with three rotating parts between two stationary parts of the cylinder, with no additional rings in rotating parts and with lateral plates in eccentric openings in covers—longitudinal cross-section.

FIG. 25 shows p-v diagram of working cycles of a driving vane machine with cylinder having stationary and rotating component parts, in case of compressible working media.

The work of a vane machine with cylinder stationary and rotating parts, for one rotor revolution, is the algebraic sum of the works of charging, expansion and discharge. The process may be described simply in a closed working cycle with compressible working media. The working chamber charging is isobaric, change of the state from a to b. The expansion process is the change of the working chamber volume from b to c. The working media discharge consists of three stages. The first stage is a sudden expansion from c to c', when the exhaust canals start opening. The second stage of exhaust from c' to d is discharge caused by the working volume decrease. The third stage, from d to a', is compression of the residual working media in the working chamber after closing of the exhaust canals. The last stage of the cycles is charging the working chamber with new working media, wherefore the isochoric pressure suddenly rises from a' to a.

The following equation shows the process and results from the energy equilibrium:

$$EdQ+dZ_M=dU+dL+dZ_V$$

where:

EdQ is the energy brought in with the working media of the G mass dU is the inner energy change dL is the work exchanged with the environment $dZ_M$ is the energy quantity brought into the working chamber as resulting from losses $dZ_V$ is the energy quantity not used in the working chamber but taken into the environment with the working media The last two energy quantities may be determined with the following equations:

$$dZ_M=P_M dG_M \text{ and } dZ_V=P_V dG_V,$$

where:

$P_M$ is the specific energy of the working media entering the cycles $P_V$ is the specific energy of the working media leaving the cycles $dG_M$ is the mass of the new working media entering the working chamber in a single cycle from the environment $dG_V$ is the mass of the new working media leaving the working chamber in a single cycle into the environment The primary problem of the vane-machine total efficiency is the volumetric efficiency, resulting from charging and discharging the working media in and from the working chamber (processes a'-a and c-c'-d-a' in the p-v diagram). The volumetric efficiency problem is solved in this invention by the possibility of maximum utilization of the stationary part of the working-chamber cylindrical wall for the working-media radial intake and exhaust canals. The structural design enables additional increase of cross-sections of the working-media intake and exhaust canals, since vane does not touch the canals, wherefore the canals may be designed as rectangular openings, which design reaches their largest possible area, which improves conditions of charging and discharging of the vane-machine working chamber.

Another important problem solved by the invention is wearing of the vanes, the rotating bearing inner or additional rings, and the rotating rotor plates. Introduction of roller or sliding bearings, the inner rings of which may be firmly inserted additional rings of adequate sliding properties, against which the vanes lean, decreases the relative speed of sliding at the sliding contact points, thereby their wear as well.

The vanes may be axially moved, wherefore they lean against the rotor lateral plates. In the existing vane-machine embodiments, the cylinder working chamber lateral plates are stationary, wherefore the resulting high velocities between the vane lateral edge and the lateral plates cause wear of both surfaces in contact. Introduction of lateral rotating plates at the rotor, that close the working chamber, decreases the relative velocities related to the vanes, wherefore the lateral wear caused by friction of vanes and plates is decreased. The relative velocities between the vane lateral edges and the working chamber plates results from the radial motion of the vane only. Decrease of the friction losses improves the machine's mechanical efficiency.

Presentation of Vane Machine With Several Stationary and Rotating Cylinder Parts The cylinder stationary and rotating parts may, besides the above described basic vane-machine version, be distributed in several other ways, depending on the given technical characteristics of the machine. FIGS. 25-30 show several complex embodiments of vane machines with various numbers, forms and mutual positions of cylinder stationary and rotating parts.

In the embodiments presented, the lateral plates 14, rotating together with the rotor C, are placed in eccentric openings in covers D, whereas between the lateral plates 14 and the bearings 15, in which the rotor rotates, there are inserted rings 15'.

Figure 31:
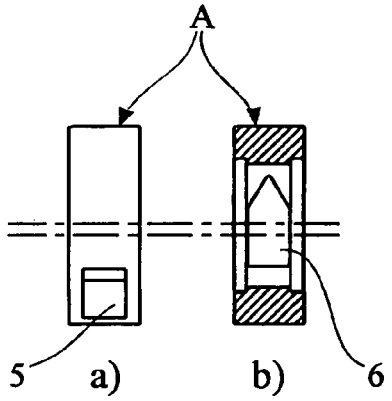
FIG. 31 shows stationary part of cylinder in FIG. 29, with opening letting the fluid in and out of the chamber: a) front view and b) cross-section.
Figure 32:
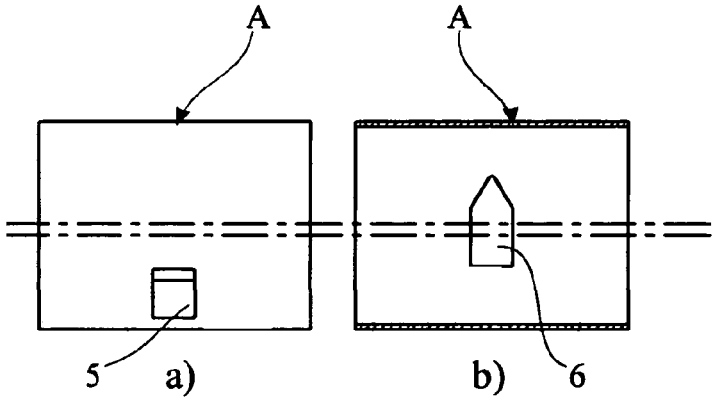
FIG. 32 shows position of the media letting the fluid in and out of the chamber: a) front view and b) cross-section.

In vane machines with several stationary cylinder parts, in each of them are made rectangular openings letting the working fluid in (5) and out (6) of the working chamber 16 of the cylinder, FIGS. 31 *a*) and *b*), or are made with working fluid intakes and exhausts through the vane-machine casing, FIGS. 32 *a*) and *b*). The working-fluid exhaust radial opening may, at the beginning of the exhaust, have the surface cross-section narrowed with a gradual increase of the surface cross-section, aimed to decreasing the noise.

Figure 33:
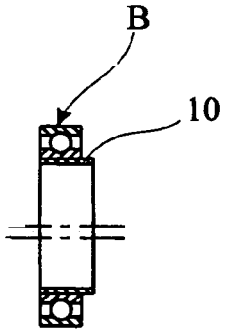
FIG. 33 shows rotating part of cylinder with wider additional ring—cross-section.
Figure 34:
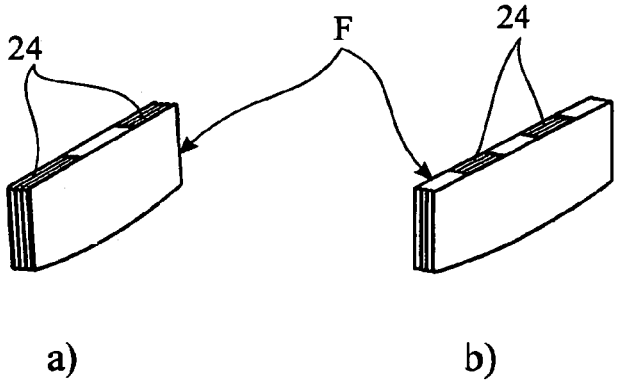
FIG. 34 shows vanes with axial grooves at the upper side of the body, adjusted with position of rotating parts of cylinder: a) for two, and b) for three rotating parts of cylinder.
Figure 1:
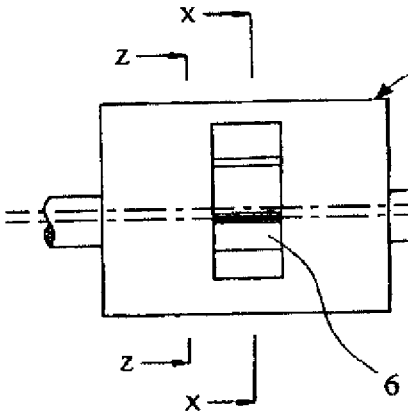
Figure 2:
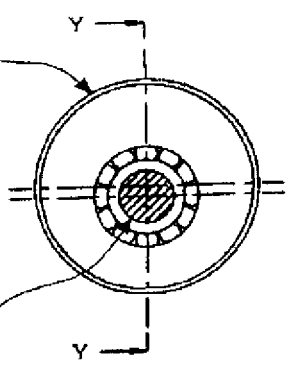
Figure 3:
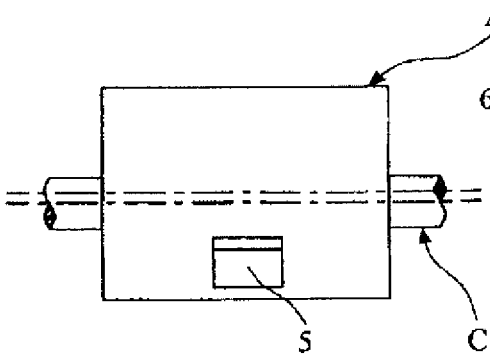
Figure 4:
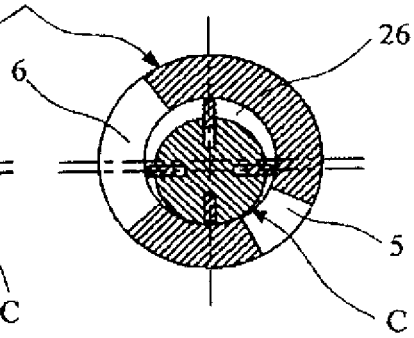
Figure 11:
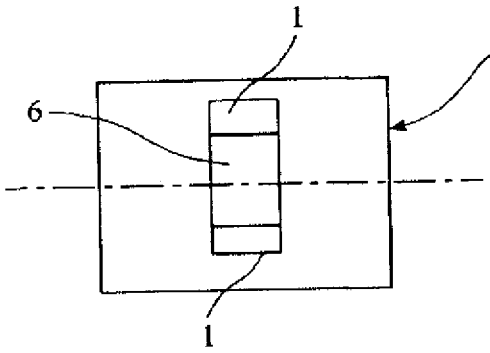
Figure 12:
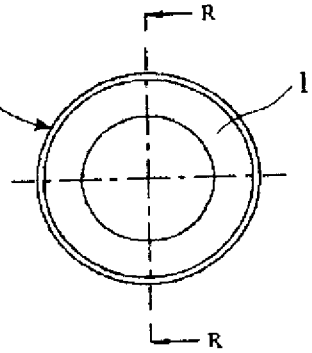
Figure 13:
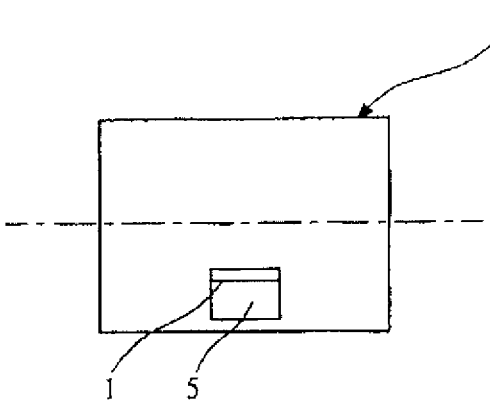
Figure 14:
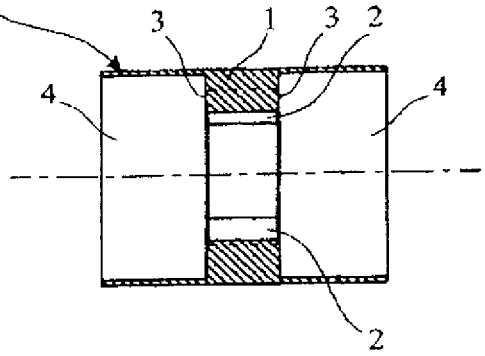
Figure 16:
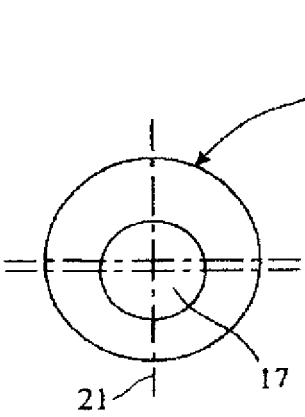
Figure 15:
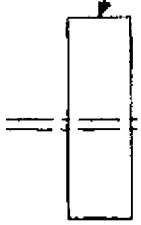
Figure 17:
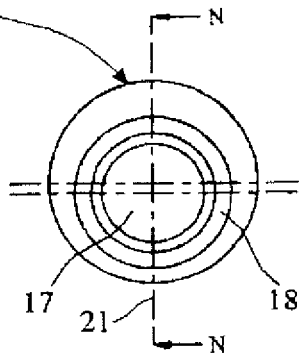
Figure 18:
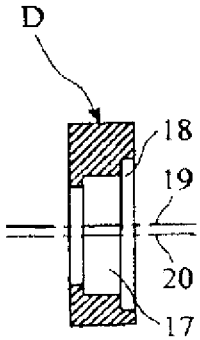

The additional rings 10 on rotating parts of the cylinder B can be wider than the inner ring 8, FIG. 33. Position of the axial grooves 24 on the vanes F is also adjusted to the distribution of rotating parts of the cylinder B, FIGS. 33 and 34. Distribution of stationary and rotating cylinder parts, in more complex vane-machine versions, may result in a different shape and distribution of other parts placed in the casing of such a vane machine.

The above mentioned complex vane-machine versions do not change the spirit of the invention as presented in the basic version of the vane-machine with stationary and rotating cylinder parts.

7. INVENTION APPLICATION

The vane machine with cylinder stationary and rotating parts may be applied in industry as driving or working machine. When used as a working machine, the imported mechanical work, with a given flow, is transformed into change of pressure of compressible or uncompressible working fluid, and when used as a driving machine, it transforms the primary available pressure of compressible or uncompressible working fluid into mechanical work.

As a working or driving machine with compressible fluid, it is used as: pneumatic tool, in mechanization of various technological processes, as large Diesel engine starter, compressor, vacuum pump, internal-combustion engine.

As a working or driving machine with uncompressible fluid, it is used with: force, movement and momentum transmission systems in building machines, hydraulic cranes, ship hydraulic systems, machine hydro-drive, and with control, regulation or protection in hydraulic systems aimed to automation of working processes.

As a pump or a hydro-engine, it has two fields of application-with regard to the working fluid. When the working fluid is mineral oil, self-lubrication decreases friction and, therefore, wear of the vanes and the casing, which makes the vane-machine greatest setback. This is applied with force, movement and momentum transmission systems in building machines, hydraulic cranes, ship hydraulic systems, machine hydro-drive, and with control, regulation or protection in hydraulic systems aimed to automation of working processes. Hydraulic vane machines have a wide range of rotation speed. Small inertial forces of its rotating parts often make starting and stopping of the machine easier. When applied with non-lubricant working media, the issue of vane and casing wear remains the main hindrance in vane machines or pumps.

Letters and numbers used in the invention description have the following meanings:

A—Stationary Part of the Cylinder
1—shroud
2—shroud working surface
3—shroud lateral surfaces
4—lateral openings in the stationary part of the cylinder
5—working fluid intake
6—working fluid exhaust
B—Rotating Parts of the Cylinder
7—outer ring of the cylinder rotating part
8—inner ring of the cylinder rotating part
9—inner ring working surface
10—additional ring
26 roller or sliding bearings.
C—Rotor
11—rotor shaft
12—rotor body
13—vane slots
14—rotor lateral plate
15—rotor bearings
16—cylinder working chamber
27—cylinder ends and the second new paragraph comprising:
28—longitudinal grooves.
D—Cover
17—cover eccentric openings for the rotor bearings
18—cover openings for the rotor lateral plate
19—cover axial axis
20—eccentric-opening axial axis
21—opening radial axis
F—Vanes With Grooves
22—vane body
23—vane flat parts without grooves
24—axial grooves
25—radial grooves

The invention claimed is:

1. A vane machine used as a driving or a working machine utilising compressible or non-compressible fluids as the working media, said vane-machine comprising:

a stationary cylinder part (A) having a shroud with working surfaces and lateral surfaces forming openings;

two or more rotating cylinder parts (B) consisting of bearings firmly fitted into the openings of the stationary cylinder part and adjacent the shroud's working surfaces and rotate freely about a cylinder axis; said rotating cylinder parts and shroud working surfaces and lateral surfaces form a cylinder working chamber having cylinder ends;

said stationary cylinder part having a plurality of radial openings letting working fluid in and out of the cylinder working chamber;

a rotor (C) having a plurality of vanes (F) that axially rotates within the cylinder working chamber and eccentrically rotate within the shroud about shroud axes, said vanes positioned within grooves within radial surfaces of the rotor;

at least two covers (D) positioned centrically in openings of the cylinder stationary parts, the covers have eccentric openings in which include firmly fitted bearings in which encase the rotor to enable the rotor rotational movement;

at least two lateral plates (14) being firmly pulled over the rotor with which they rotate jointly at the same angle speed and around the same axis;

wherein each said vanes has at least one flat upper surface (23) with longitudinal axial grooves (24) and longitudinal radial grooves (25);

and wherein during rotation of the rotor, the flat surfaces of the vanes are affected by the centrifugal force and make contact with the bearings of the cylinder rotating parts so that the vanes are pulled into rotation; and the longitudinal radial grooves (25) make contact with the lateral plates (14) during rotation.

2. The vane machine, as claimed in claim 1, wherein each cylinder stationary part has a radial working-fluid intake (5) and one radial working-fluid exhaust (6) from the working chamber (16); the radial working-fluid exhaust at the beginning of the exhaust has narrowing of the surface cross-section with gradual increase of the surface cross-section aimed to decreasing the noise.

3. The vane machine, as claimed in claim 1, wherein the said lateral plates (14) rotate together with the rotor (C), such that they are releasably connected with the rotor.

4. The vane machine, as claimed in claim 1, wherein the bearings of said cylinder rotating parts (B) further comprise one or more bearing rings.

5. The vane machine, as claimed in claim 4, wherein embody additional rings (10) within cylinder rotating parts (B) said rings having widths greater than the width of the bearings.

6. The vane machine, as claimed in claim 1, wherein position of the said longitudinal axial grooves (24) on the vanes (F), are adjusted in accordance with distribution of the cylinder stationary parts (A) and rotating parts (B).

7. The vane machine, as claimed in claim 1, wherein it has one cylinder rotating part (B) between two cylinder stationary parts (A), where the lateral plates (14) rotate in eccentric openings of the cover (D).

8. The vane machine, as claimed in claim 1, wherein it has two cylinder rotating parts (B) between two cylinder stationary parts (A), where the lateral plates (14) rotate in eccentric openings of the cover (D).

9. The vane machine, as claimed in claim 1, the rotor further comprises a radial outer surface that includes a plurality of longitudinal grooves for labyrinth type sealing.

10. The vane machine, as claimed in claim 1, wherein it has two cylinder stationary parts (A) between three cylinder rotating parts (B), where the rotating parts are placed at the cylinder ends, where the lateral plates (14) rotate in eccentric openings of the covers (D).

* * * * *

UNITED STATES PATENT AND TRADEMARK OFFICE

CERTIFICATE OF CORRECTION

PATENT NO. : 8,047,824 B2
APPLICATION NO. : 12/224591
DATED : November 1, 2011
INVENTOR(S) : Nebojsa Boskovic and Branimir Matijasevic It is certified that error appears in the above-identified patent and that said Letters Patent is hereby corrected as shown below:

Drawing Sheets:

Sheet 1 of 6: Please replace Sheet 1 of 6 with the enclosed (and correct) Drawing Sheet for Sheet 1 of 6.

Sheet 3 of 6: Please replace Sheet 3 of 6 with the enclosed (and correct) Drawing Sheet for Sheet 3 of 6.

State of the Art:

Col. 1, line 60: Please replace “ware” with -- wear --

Detailed Description of One of the Invention Best Embodiments and Its Functioning:

Col. 6, line 36: Please replace “ware” with -- wear --

Invention Application:

Col. 9, line 23: Please replace “27—cylinder ends and the second new paragraph comprising:” with -- 27—cylinder ends --

In the Claims:

Claim 1, Col. 10, line 9: Please replace “vanes” with -- vane --

Signed and Sealed this
Twenty-first Day of February, 2012

David J. Kappos

David J. Kappos
*Director of the United States Patent and Trademark Office*